US008893750B2

(12) United States Patent
Hockemeyer et al.

(10) Patent No.: US 8,893,750 B2
(45) Date of Patent: Nov. 25, 2014

(54) DEVICE FOR MANUFACTURING A FABRIC, AND FABRIC

(71) Applicant: Gebrüder Klöcker GmbH, Borken-Weseke (DE)

(72) Inventors: Kurt Hockemeyer, Borken (DE); Christoph Schwemmlein, Borken (DE)

(73) Assignee: Gebrüder Klöcker GmbH, Borken-Weseke (DE)

( * ) Notice: Subject to any disclaimer, the term of this patent is extended or adjusted under 35 U.S.C. 154(b) by 64 days.

(21) Appl. No.: 13/891,564

(22) Filed: May 10, 2013

(65) Prior Publication Data

US 2013/0333794 A1 Dec. 19, 2013

(30) Foreign Application Priority Data

May 11, 2012 (DE) ..... 10 2012 009 420

(51) Int. Cl.

| | |
|---|---|
| ***D03C 7/00*** | (2006.01) |
| ***D03D 19/00*** | (2006.01) |
| ***D03C 7/08*** | (2006.01) |
| ***D03C 7/06*** | (2006.01) |
| *D03C 13/00* | (2006.01) |

(52) U.S. Cl.

CPC *D03D 19/00* (2013.01); *D03C 7/08* (2013.01); *D03C 7/06* (2013.01)

USPC ..... 139/50; 139/54; 139/430; 139/11; 139/35

(58) Field of Classification Search

CPC ..... D03C 7/04; D03C 7/08; D03C 7/00; D03C 7/06; D03C 11/00

See application file for complete search history.

(56) References Cited

U.S. PATENT DOCUMENTS 5,996,646 A * 12/1999 Hockemeyer et al. ..... 139/54
6,098,669 A * 8/2000 Klocker et al. ..... 139/54

(Continued)

FOREIGN PATENT DOCUMENTS

DE 29708758 U1 7/1997
DE 19647495 C1 1/1998

(Continued)

OTHER PUBLICATIONS

European Search Report for EP 13 00 1770 dated Jul. 2, 2013.

*Primary Examiner* — Bobby Muromoto, Jr.

(74) *Attorney, Agent, or Firm* — Gifford, Krass, Sprinkle, Anderson & Citkowski, P.C.; Douglas L. Wathen

(57) ABSTRACT

A device for manufacturing a fabric has a plurality of automatically working apparatus arranged next to one another on at least one carrier for manufacturing a leno weave (a leno weave apparatus). Two leno threads are fed to each leno weave apparatus. The device has at least one weft thread picking device; wherein the weft thread is introduced into the shed of leno threads raised by a plurality of leno weave apparatus. The weft thread is bound using at least two leno threads at a plurality of points behind the weft thread over the width of the fabric. At least one of the leno weave apparatus arranged in the end region of the fabric carries out a higher number of interlacings for achieving a homogenized warp tension distribution over the width of the fabric; and/or the lowering of the shed is carried out by the leno weave apparatus over the width of the fabric at different times for achieving a homogenized warp tension distribution.

12 Claims, 3 Drawing Sheets

(56) References Cited

U.S. PATENT DOCUMENTS

| | | | | |
|---|---|---|---|---|
| 6,179,012 | B1 * | 1/2001 | Nowack et al. | 139/54 |
| 6,244,304 | B1 * | 6/2001 | Hockemeyer et al. | 139/54 |
| 6,246,147 | B1 * | 6/2001 | Hockemeyer et al. | 310/268 |
| 6,286,560 | B1 * | 9/2001 | Schwemmlein et al. | 139/54 |
| 6,814,107 | B2 * | 11/2004 | Schwemmlein et al. | 139/54 |
| 7,040,354 | B2 * | 5/2006 | Schwemmlein et al. | 139/430 |
| 8,590,578 | B2 * | 11/2013 | Schwemmlein et al. | 139/35 |
| 2013/0160890 | A1 * | 6/2013 | Schwemmlein et al. | 139/50 |

FOREIGN PATENT DOCUMENTS

| | | | |
|---|---|---|---|
| DE | 19743872 | C1 | 12/1998 |
| DE | 10003919 | A1 | 8/2001 |
| DE | 10034355 | A1 | 1/2002 |
| EP | 1052317 | A1 | 11/2000 |
| EP | 1302575 | A2 | 4/2003 |
| GB | 2124664 | A | 2/1984 |
| JP | S4415021 | | 6/1969 |

* cited by examiner

DEVICE FOR MANUFACTURING A FABRIC, AND FABRIC

CROSS REFERENCE TO RELATED APPLICATION

This U.S. patent application claims priority from German patent application Serial No. DE 102012009420.5, filed May 11, 2012, the content of which is incorporated herein in its entirety.

FIELD OF THE INVENTION

The invention relates to a device for manufacturing a fabric and to a fabric.

BACKGROUND OF THE INVENTION

Such devices for fabric manufacture are known as conventional looms. Such a loom comprises a plurality of heddle shafts driven in opposite directions, wherein a plurality of heddles are arranged beside one another ON the heddle shafts, with the warp threads running off the warp beam being guided through the heddles. The shafts run in opposite directions to one another so that a shed is raised by the heddles with the warp threads guided therein on such an oppositely directed movement of the shafts. A weft thread is guided through this raised shed, for example by means of rapiers or also by means of air. Such machines are then called either rapier machines or airjet machines. After the introduction of each pick, the weft thread is battened-to to the fabric by the reed arranged in the loom.

Such a known loom requires a substantial drive force which is substantially due to the up and down movement of the heddle shafts with the heddles arranged thereon. Drive powers of 70 kW and more are sometimes required. It is furthermore disadvantageous that only a customary fabric (linen weave) can be manufactured using such conventional weaving looms.

A loom is known from DE 100 03 919 A1 in which the weft thread is bound in the fabric by a half-cross leno weave. For this purpose, the loom has a plurality of leno weave apparatus which are arranged next to one another, but which are driven centrally by one drive.

GB 2124664 A shows a similar loom. A plurality of disks are provided there which are arranged next to one another, mesh with one another and are driven centrally by a drive disk. The disks each have two openings for the leno threads which are disposed diagonally opposite one another.

DE 100 34 355 A1 describes leno selvage formation apparatus arranged in pairs within the fabric on a loom so that each fabric has a leno selvage after cutting the fabric between the selvage formation apparatus.

SUMMARY OF THE INVENTION

The underlying object of the invention is to provide a device for manufacturing a fabric which has a comparatively small drive power and which furthermore creates the opportunity to manufacture a fabric in which a pattern can be woven. The continuous length of fabric should furthermore have a strength or tension which is as uniform as possible over a substantial portion of its width. It is the case in the manufacture of fabrics on customary looms that the strength or tension of the fabric reduces toward the edge of the fabric. The distribution of the tension over the width of a continuous length of fabric is also called inhomogeneous warp tension, i.e. the distribution of the tension drops continuously in arc form from a crown line at the center of the continuous length of fabric toward the edge of the fabric without the tension at the edge becoming zero. A continuous length of fabric with a very pronounced arcuate distribution can in particular not be used in certain technical applications. This applies e.g. to technical fabrics made from glass filaments which are also used as reinforcement fabrics, e.g. in concrete buildings. Such a fabric in accordance with the prior art also does not lie taut on the beam of the fabric take-off in the edge region, which can result in creasing in the edge region. Creased fabrics can only be further processed with limitations.

In accordance with the invention, a device for manufacturing a fabric comprises a plurality of apparatus for manufacturing a leno weave (leno weave apparatus) which are arranged next to one another on at least one carrier and which work automatically. Two leno threads are supplied to each leno weave apparatus, with the device for manufacturing the fabric having at least one weft thread picking device, with the weft thread being introduced into the shed of leno threads raised by a plurality of leno weave apparatus. The weft thread is bound using two respective leno threads over the width of the fabric at a plurality of points behind the weft thread by a plurality of leno weave apparatus. To achieve a homogenized warp tension distribution over the width of the fabric, at least one of the leno weave apparatus arranged in the edge region of the fabric carries out a higher number of interlacings than at least one leno weave apparatus arranged in the central region of the fabric. In the following, the two threads for the binding of the weft thread will be called leno threads. They are often also called ground or standard threads.

Alternatively, to achieve a homogenized warp tension distribution, the lowering of the shed can be carried out by the leno weave apparatus at different times over the width of the fabric. A homogenized warp tension distribution can also be achieved by a combination of a plurality of interfacings having a lowering of the shed differing in time.

Provision is in particular made with respect to the binding of the weft thread, i.e. the lowering of the shed, at different times that the lowering of the shed by the leno weave apparatus takes place earlier in the edge region than in the central region to restrict the possibility of movement of the weft thread. The weft thread in this respect has more time to yield toward the center of the fabric, which thus results in a homogenized distribution of tension over the width of the fabric.

The device for supplying the leno threads can be a warp beam or also a plurality of reels loaded with threads. In this respect, working automatically means that every leno weave apparatus has its own drive. This is in contrast to e.g. heddles which are externally driven by the shafts.

The drive power of such individual leno weave apparatus is at around 10 watts. Even on the arrangement of 30 or 40 such leno weave apparatus next to one another on a carrier, only a fraction of the drive power is required compared to a conventional loom having heddle shafts moving up and down in opposite directions. The reason for this is essentially that the moved mass of the individual leno weave apparatus is substantially lower with respect to the moved mass in a customary loom having heddle shafts and the heddles suspended thereon. There is also the option due to the lower moved masses and the possibility of higher speeds accompanying this of allowing such leno weave apparatus to bind multiple times between the picking of two weft threads. It is possible with such leno fabrics or also multiple leno fabrics, i.e. fabrics in which the two leno threads are interlaced with one another a multiple of times between the individual weft threads, to produce a considerably higher resistance to displacement and in this respect also a considerably open textile structure. Areas of use for such open fabrics result e.g. in textile-reinforced concrete, as reinforced plaster or e.g. as agricultural fabrics. Lens fabrics have been manufactured using conventional leno harnesses up to now, which, however, only allows very low production speeds of only around 200 picks a minute. Even if the low production speed is ignored for a moment, only half-cross leno weaves can also be manufactured using these conventional leno harnesses. In a half-cross leno weave, the leno threads are only twisted once between the weft threads. Such a weave is admittedly also characterized by a certain strength which also allows so-called open fabrics to be manufactured, i.e. fabrics which present as porous textile fabrics. The displacement strength is, however, as already explained, nevertheless not sufficient for some application purposes. Open fabrics which have extreme displaceability strength and which satisfy the highest mechanical demands can be manufactured by the use of such leno weave apparatus, as previously described, and here in particular in the form of so-called propeller lenos.

Such a propeller leno is characterized by an electric motor which comprises a rotor, with the rotor comprising two vanes disposed diagonally opposite one another for forming a propeller, with the vanes each having an eyelet for guiding the two leno threads at their end sides. It has been found that in particular glass yarns can also be processed using such leno weave apparatus without there being the risk of the breaking of such yarns in processing.

A further advantage of the use of the leno weave apparatus in accordance with the invention is that the strength of the textile can be set over the width of the continuous lengths of fabric. This applies in that the number of interlacings of the leno threads can be selected freely to a certain extent after each weft thread insertion and as a consequence thereof the strength of the fabric can also be set. It has been stated with respect to the prior art that the tension values and strength values of a conventional fabric reduce continuously from the center toward the edge. The distribution of the tensions values and strength values over the width is accordingly arcuate, as already stated. The tension distribution can be configured as constant thanks to the use of the leno weave apparatus in accordance with the invention; i.e. the continuous length of fabric has an equal strength and tension over a larger width. It follows from this that a higher strength can e.g. be achieved in the edge region either in that the number of interlacings of the leno threads is increased toward the edge or in that the number of interlacings of the leno threads is reduced in the center of the fabric in order admittedly thus to reduce the strength level and tension level, but to achieve almost equal values over a larger width. Alternatively or additionally, the binding over the width of the fabric can also be carried out by individual leno weave apparatus at different times, as has already been described.

A particularly advantageous embodiment of the device in accordance with the invention for manufacturing a fabric is characterized in that the apparatus has a second carrier extending in parallel to the first carrier, with the two carriers standing approximately in a horizontal plane with respect to one another, with a plurality of the leno weave apparatus being arranged staggered on the first front carrier, with the second carrier likewise having a plurality of leno weave apparatus arranged next to one another, with the leno weave apparatus on the second carrier being arranged in the gaps between the leno weave apparatus on the first carrier. The leno weave apparatus have a specific diameter. The diameter is substantially determined by the size of the motor, and in particular also by the radial extent of the propeller.

Since the individual leno weave apparatus are arranged staggered next to one another on the carrier, there is the possibility of arranging a second carrier behind it in the horizontal plane of the first carrier to arrange the leno weave apparatus on the second carrier exactly in the gap between the leno weave apparatus of the first carrier. This means that the spacing of the weave rows can thus be reduced between one another with the consequence that the porosity of the fabric can be set very amply.

It has already been pointed out that the leno weave apparatus has a device for the rotatable acceptance of leno threads. Provision is made in accordance with a particularly advantageous feature that the devices for receiving the leno threads are configured in the leno weave apparatus on the second carrier such that the shed raised by them is larger than the shed of the leno weave apparatus on the first carrier. This means that the propeller is larger with respect to a propeller leno. This in light of the following:

The leno weave apparatus on the second carrier are located spaced toward the rear with respect to the leno weave apparatus on the first carrier. This has the consequence that the shed raised by the leno weave apparatus on the second carrier has a lower height in direct proximity to the fabric edge than the shed which is formed by the leno weave apparatus on the first carrier. If provision is now made that the shed formed by the leno weave apparatus on the second carrier is larger than the shed raised by the leno weave apparatus on the first carrier, the different shed size due to the rows of leno weave apparatus arranged offset behind one another can hereby be compensated. It is again pointed out in this connection that in particular propeller lenos should be used, with it being advantageous that with such a propeller leno only the propeller has to be increased in size to be able to provide a large shed.

In accordance with a further feature of the invention, the apparatus for manufacturing a fabric includes a reed which serves to batten the weft thread to the fabric.

A fabric manufactured using an apparatus such as has been described above is likewise a subject of the invention. The fabric is characterized in this respect in that a weft thread is bound using two respective leno threads over the width of the fabric at a plurality of points behind the weft thread (40) by a plurality of leno weave apparatus, that is before the reed, by a plurality of leno weave apparatus using a respective two leno threads. The two leno threads are each received by a leno weave apparatus being connected to one another by a different number of interlacings by the leno weave apparatus. This has the consequence that every leno weave apparatus which receives a leno thread pair can bind the weft thread with a different number of interlacings over the width of the fabric. Provision can thus e.g. be made, as was also already explained at another point, to increase the number of the interlacings toward the edge region to achieve a constant tension distribution over the width of the fabric. This means that a homogenization of the tension distribution dropping in arcuate manner takes place toward the sides of a fabric in this respect. This is done in that a tension distribution substantially constant over the width can be achieved in the edge region by an increased number of interlacings of the leno threads with one another with respect to the central region of a fabric. The number of interlacings can in this respect be freely combined between half an interlacing, i.e. an interlacing of the two leno threads by 180°, with interlacings which also amount to a multiple of 360°.

A fabric is also a subject matter in which the binding of the weft thread over the width of the fabric is carried out at different times for homogenizing the arcuate tension distribution. The binding of the weft thread, thus the lowering of the shed, can in particular take place earlier in the edge region than in the central region of the fabric. The edge region of the fabric comprises around 20%-30% of the fabric width.

The invention will be described in more detail below by way of example with reference to the drawings.

DETAILED DESCRIPTION OF THE INVENTION

Figure 1:
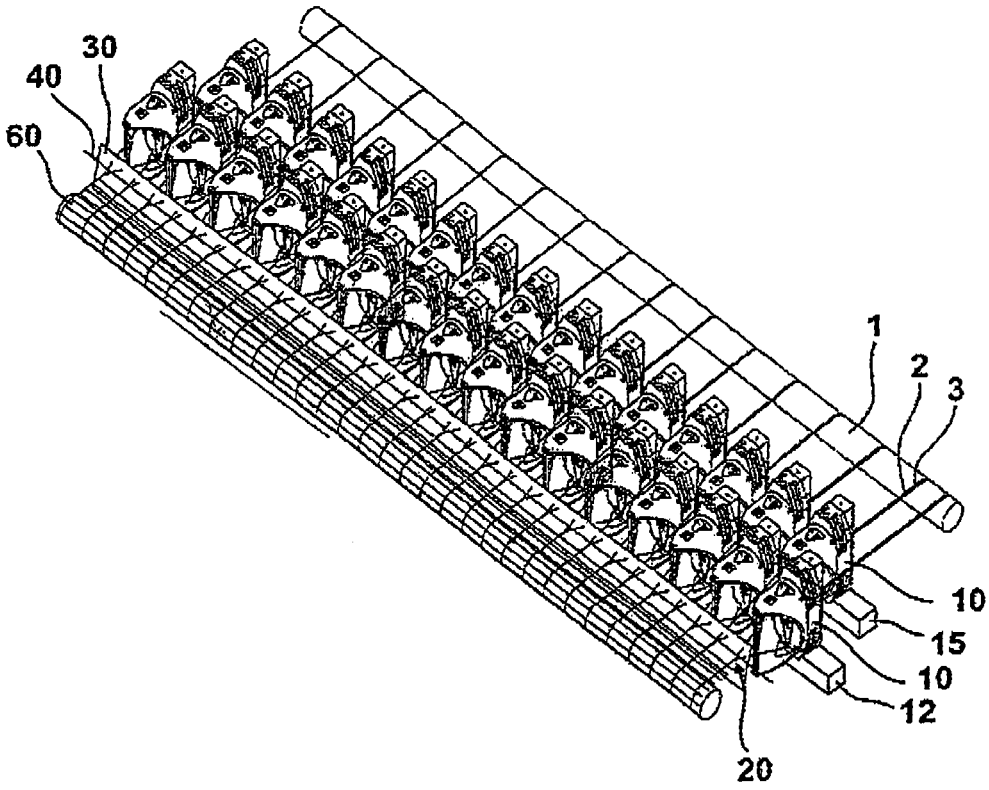
FIG. 1 shows the apparatus for manufacturing a fabric in a schematic representation.

The two leno threads 2 and 3 are located on the warp beam. It is, however, also conceivable to provide reels for the reception of the leno threads. The leno threads 2 and 3 are supplied to the leno weave apparatus shown at 10. A plurality of such leno weave apparatus 10 are arranged next to one another over the width of the fabric on a first carrier 12. A second carrier 15 likewise has leno weave apparatus 10 arranged thereon and is located at the same height in parallel to the first carrier 12. The leno weave apparatus 10 on the two carriers have the same design in principle. There is a spacing between the leno weave apparatus 10 arranged on the first carrier 12, with the spacing being such that the leno web apparatus 10 arranged on the carrier 15 are likewise able to form a shed in the gap between two respective leno weave apparatus 10 on the first carrier 12. This means that space must also remain for the rotation of the propeller. It has already been pointed out that the leno weave apparatus arranged on the second carrier 15 can have a propeller which has a greater radial extent than the propeller of the leno weave apparatus 10 on the first carrier 12. This is against the background that the second carrier 15 has a greater spacing from the fabric edge, which is marked by the arrow 20. This means that the shed would be correspondingly smaller directly at the fabric edge, than the shed which is raised by the leno weave apparatus 10 on the first carrier 12. This can be compensated by a larger propeller. The apparatus furthermore has a reed 30 which, as is known, serves to batten the weft thread 40 picked into the shed. The finished fabric is received by the fabric take-off beam 60.

Figure 2:
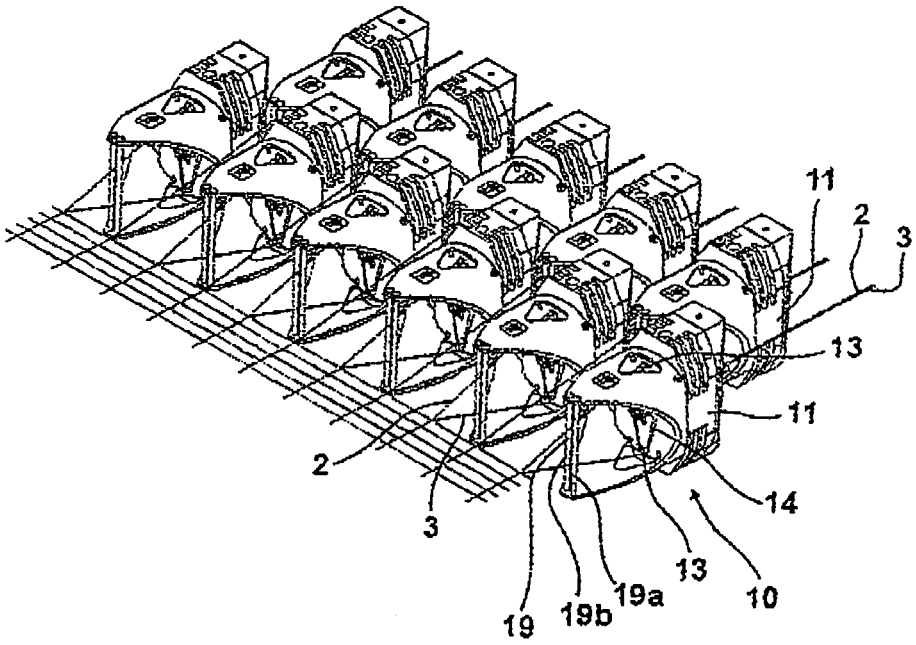
FIG. 2 shows a number of leno weave apparatus of FIG. 1 in an enlarged representation.

The configuration of the leno weave apparatus 10 as a propeller leno is shown in detail in FIG. 2. A propeller leno comprises an electric motor 11 having a propeller 14 arranged on the rotor of the motor. The propeller 14 is presented as an arm which has two eyelets 13 which are disposed diagonally opposite one another at the end side and through which the leno threads 2, 3 are guided. The propeller leno furthermore has a guide 19 in the front region comprising two guide bars 19*a* and 19*b* which extend in parallel with one another and between which the leno threads are guided, as shown in FIG. 2. The propeller rotates multiple times in one direction for establishing inter alia the binding of the weft thread. The leno threads in this respect twist on the feed side of the threads to the propeller leno, that is, on the rear of the propeller leno. After picking the next weft thread, the rotation of the propeller takes place in the opposite direction, i.e. the twisting on the rear of the propeller leno is cancelled.

Figure 3:
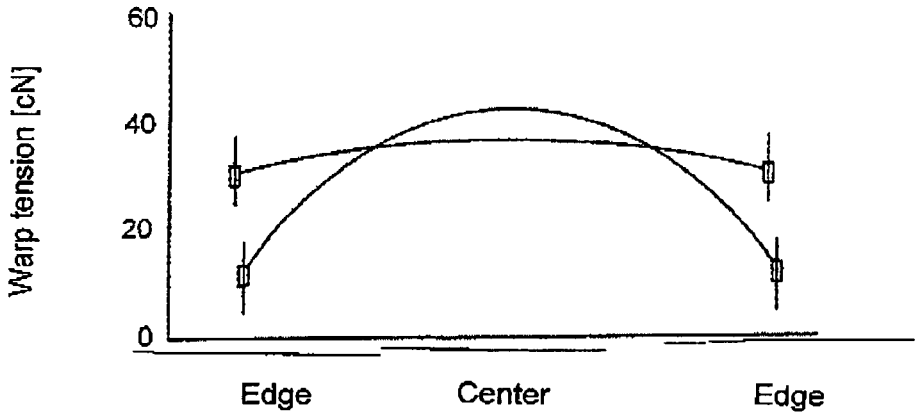
FIG. 3 shows the arcuate tension distribution and strength distribution over the width of the fabric.

FIG. 3 shows a diagram in which the warp tension is entered over the width of the fabric. In this respect, the arcuate tension distribution over the width of a fabric in accordance with the prior art can be recognized. A distribution of the warp tension over the width of the fabric is likewise entered in which the tension is constant or at least substantially more constant over the width of the fabric.

Figure 4:
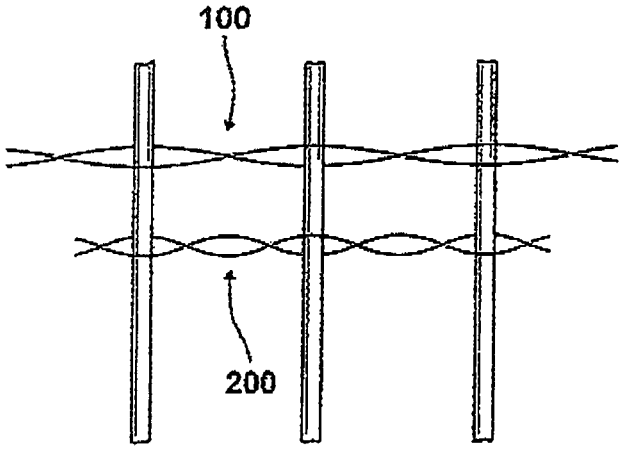
FIG. 4 shows a fabric by way of example in which the leno thread pairs of a plurality of leno weave apparatus arranged behind one another have a different number of interlacings.

FIG. 4 schematically shows the different weave type of a weft thread over the width of the fabric. In this respect, a half-cross leno weave is marked by the arrow 100, a full leno weave by the arrow 200. These previously named weave types can be combined with one another as desired over the width of the fabric, i.e. half-cross leno weaves can, for example, be provided at various points and full leno weaves at other points. It is likewise conceivable to provide multiple weaves of full leno weaves, i.e. weaves with a whole-number multiple of 360°.

REFERENCE NUMERAL LIST

1 warp beam
2, 3 leno threads
10 leno weave apparatus
11 motor
12 first carrier
13 eyelets of the propeller
14 propeller
15 second carrier
19 guide
19*a*, 19*b* guide bars of the guide 19
20 fabric edge
30 reed
40 weft thread
60 fabric removal beam
100 arrow for half-cross leno weave
200 arrow for full leno weave

The invention claimed is:

1. A device for manufacturing a fabric, comprising:
at least one carrier;
a plurality of leno weave apparatus disposed on the at least one carrier, wherein two leno threads are fed to each leno weave apparatus, and each leno weave apparatus is operable to raise a shed of the corresponding leno thread;
at least one weft thread picking device;
wherein a weft thread is introduced into the shed of each of the leno threads raised by the leno weave apparatus;
wherein the weft thread is bound using at least two leno threads over the width of the fabric at a plurality of points behind the weft thread;
wherein at least one of the leno weave apparatus disposed in an end region of the fabric carries out a higher number of interlacings for achieving a homogenized warp tension distribution over a width of a fabric than at least one leno weave apparatus arranged in a central region of the fabric and/or wherein the closing of the shed is carried out by the leno weave apparatus over the width of the fabric at different times for achieving a homogenized warp tension distribution.

2. A device for manufacturing a fabric in accordance with claim 1, wherein:
the leno weave apparatus each comprise a device for the rotatable reception of the two leno threads.

3. A device for manufacturing a fabric in accordance with claim 2, wherein:
the device for the rotatable reception of the two leno threads comprises a two-vane propeller having end-side eyelets for guiding the two leno threads.

4. A device for manufacturing a fabric in accordance with claim 1, wherein:

the leno weave apparatus are individually controlled.

5. A device for manufacturing a fabric in accordance with claim 1, wherein:

the at least one carrier comprises a first front carrier and a second rear carrier extending in parallel to the first carrier, the two carriers being disposed approximately in a horizontal plane with respect to one another;

wherein some of the plurality of leno weave apparatus are staggered on the first front carrier;

wherein some of the plurality of leno weave apparatus are staggered on the second carrier; and wherein the leno weave apparatus on the second carrier are arranged in gaps between the leno weave apparatus on the first carrier.

6. A device for manufacturing a fabric in accordance with claim 5, wherein:

the leno weave apparatus disposed on the second carrier are configured such that the shed raised by the them is larger than the shed raised by the leno weave apparatus on the first carrier.

7. A device for manufacturing a fabric in accordance with claim 1, further comprising:

a reed.

8. A device for manufacturing a fabric in accordance with claim 4, wherein:

the weft thread is bound earlier by the leno weave apparatus in an edge region of the fabric than in a central region of the fabric.

9. A device for manufacturing a fabric in accordance with claim 1, wherein:

wherein the respective two leno threads received by a leno weave apparatus are connected to one another by a different number of interfacings by the leno weave apparatus.

10. A device for manufacturing a fabric in accordance with claim 6, wherein:

the number n of interlacings of the leno threads of a leno weave apparatus is in the range of n=½ to n=20.

11. A fabric manufactured using a device in accordance with claim 1, wherein:

a weft thread is bound by a plurality of leno weave apparatus using at least two leno threads over the width of the fabric at a plurality of points behind the weft thread; and the binding of the weft thread is carried out by the leno weave apparatus at different times over the width of the fabric.

12. A fabric in accordance with claim 11, wherein:

the binding takes place earlier in the edge region of the fabric than in the central region of the fabric.

* * * * *